US007734014B2

(12) United States Patent
Bergmann et al.

(10) Patent No.: US 7,734,014 B2
(45) Date of Patent: Jun. 8, 2010

(54) EXTREME UV AND SOFT X RAY GENERATOR

(75) Inventors: Klaus Bergmann, Herzogenrath (DE); Willi Neff, Kelmis (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 850 days.

(21) Appl. No.: 10/567,038

(22) PCT Filed: Jul. 29, 2004

(86) PCT No.: PCT/IB2004/051323

§ 371 (c)(1),
(2), (4) Date: Oct. 10, 2006

(87) PCT Pub. No.: WO2005/015602

PCT Pub. Date: Feb. 17, 2005

(65) Prior Publication Data

US 2008/0143228 A1 Jun. 19, 2008

(30) Foreign Application Priority Data

Aug. 7, 2003 (DE) ..... 103 36 273

(51) Int. Cl.
*H01J 35/06* (2006.01)
*H01J 35/02* (2006.01)
*G21G 4/00* (2006.01)

(52) U.S. Cl. ..... 378/119; 378/136

(58) Field of Classification Search ..... 378/119, 378/122, 136, 210; 250/423 R, 425, 426, 250/493.1, 503.1, 504 R, 504 H; 313/231.31; 315/111.21, 111.31, 111.41, 111.51, 111.71
See application file for complete search history.

(56) References Cited

U.S. PATENT DOCUMENTS

| | | | | | |
|---|---|---|---|---|---|
| 3,005,931 | A | * | 10/1961 | Dandl | 376/128 |
| 3,315,125 | A | * | 4/1967 | Frohlich | 315/111.81 |
| 4,749,912 | A | * | 6/1988 | Hara et al. | 315/111.81 |
| 4,841,197 | A | * | 6/1989 | Takayama et al. | 315/111.81 |
| 4,894,546 | A | * | 1/1990 | Fukui et al. | 250/423 R |
| 5,023,897 | A | * | 6/1991 | Neff et al. | 378/122 |
| 5,083,061 | A | * | 1/1992 | Koshiishi et al. | 315/111.81 |
| 5,241,243 | A | * | 8/1993 | Cirri | 315/111.21 |
| 5,397,956 | A | * | 3/1995 | Araki et al. | 313/231.31 |
| 5,539,274 | A | * | 7/1996 | Araki et al. | 313/362.1 |
| 2003/0006383 | A1 | * | 1/2003 | Melnychuk et al. | 250/504 R |
| 2005/0248284 | A1 | * | 11/2005 | Burtner et al. | 315/111.41 |

FOREIGN PATENT DOCUMENTS

| | | | |
|---|---|---|---|
| DE | 10134033 | A1 | 10/2002 |
| WO | 99/29145 | A1 | 6/1999 |
| WO | 01/01736 | A1 | 1/2001 |

* cited by examiner

*Primary Examiner*—Edward J Glick
*Assistant Examiner*—Anastasia Midkiff

(57) ABSTRACT

A gas discharge source, in particular, for generating extreme ultraviolet and/or soft X-radiation, has a gas-filled intermediate electrode space located between two electrodes, devices for the admission and evacuation of gas, and one electrode that has an opening that defines an axis of symmetry and is provided for the discharge of radiation. A diaphragm exhibits at least one opening on the axis of symmetry and operates as a differential pump stage, between the two electrodes.

13 Claims, 5 Drawing Sheets

EXTREME UV AND SOFT X RAY GENERATOR

The invention relates to a gas discharge source. Preferred application area are those requiring extreme ultraviolet and/or soft X-radiation in the wavelength range from approximately 1 nm to 20 nm, such as, in particular, semiconductor lithography.

A device of the same generic type is disclosed in WO 99/29145. FIG. 1 originating from this shows an electrode arrangement in which a gas-filled intermediate electrode space is located between two electrodes. The two electrodes are each equipped with an opening, by which an axis of symmetry is defined. The device operates in an environment of constant gas pressure. If a high voltage is applied to the electrodes, there is a gas breakdown, which depends on the pressure and the electrode spacing. The pressure of the gas and the electrode spacing are selected such that the system operates on the left branch of the Paschen curve and, as a result, no electrical breakdown occurs between the electrodes. The gas discharge cannot propagate between the electrodes because, in this case, the mean free path length of the charge carriers is greater than the electrode spacing. Instead, the gas discharge seeks a longer path, since a sufficiently great number of ionizing collisions to trigger the discharge is possible only with a sufficiently large discharge gap. This longer path can be predetermined by means of the electrode openings via which the axis of symmetry is defined. A current-carrying plasma channel, axially symmetric in shape, develops in line with the electrode openings. The extremely high discharge current creates a magnetic field around the current path. The resultant Lorentz force constricts the plasma and the plasma is thereby heated to very high temperatures, wherein it emits very short wavelength radiation, in particular in the EUV and soft X-radiation wavelength range. The extraction of the radiation takes place in the axial direction, along the axis of symmetry, through the opening of one of the electrodes.

For application in EUV lithography, plasmas should exhibit an axial expansion of 1 to 2 mm and a diameter again of 1 to 2 mm, and be visually accessible at an observation angle of 45 to 60 degrees. It is generally known that plasmas of this kind, for this application, are optimally generated in electrical discharges with pulse energies in the range of a few joules, a current pulse duration of around 100 ns and current amplitudes between 10 and 30 kA. The optimum neutral gas pressure typically lies in the range of a few Pa to some 10 Pa. The starting radius for compression of the plasma, which is essentially determined by the openings in the electrode system, lies in the range of a few mm. The spacing between the electrodes is between 3 and 10 mm.

WO 01/01736 A1 discloses a device of the same generic type, in which, in addition, an auxiliary electrode exhibiting an opening on the axis of symmetry is present between the main electrodes as a means of increasing the conversion efficiency.

DE 101 34 033 A1 discloses a device of the same generic type, in which the gas pressure of the gas filling is higher close to an electrode taking the form of a cathode than in an area of the discharge vessel at a distance from it.

The devices described as part of the prior art are, however, not capable of supplying the high outputs required for many applications, in particular for semiconductor lithography. Improvements are therefore necessary in order to achieve the highest possible radiation intensity. It should, however, also be noted that, for the necessarily high current amplitudes and current densities, the current transfer via the cathode is inevitably associated with vaporization of cathode material. Electrode erosion of this kind leads to a geometrical change in the cathode, which ultimately has a negative effect on the emission properties of the plasma. This is the case all the more rapidly the nearer to the cathode surface the pinch plasma is oriented. For the usefulness of devices of this kind, however, a sufficiently long service life is essential.

It is therefore an object of the invention to provide a device for generating a radiation-emitting plasma, with which a high radiation intensity in the wavelength range between $\lambda$=1 to 20 nm, i.e. in the EUV range and the soft X-radiation wavelength range, can be achieved and extracted as effectively as possible, and which exhibits a service life that is as long as possible.

The invention recognizes that the above-described technical problem is solved by means of a gas discharge source, in particular for generating extreme ultraviolet and/or soft X-radiation, in which a gas-filled intermediate electrode space (3) is located between two electrodes (1, 2), in which devices for the admission and evacuation of gas are present, in which one electrode (1) exhibits an opening (5) that defines an axis of symmetry (4) and is provided for the discharge of radiation, and in which a diaphragm (6), which exhibits at least one opening (7) on the axis of symmetry (4) and operates as a differential pump stage, is present between the two electrodes (1, 2).

The invention is based on the recognition that, as a result of introducing a diaphragm (6) exhibiting an opening (7) on the axis of symmetry (4) and of using this diaphragm as a differential pump stage, certain desired pressure conditions can, in a simple manner, be set in the intermediate electrode space (3). In addition to the resultant advantages, a larger surface over which heat can be dissipated is present in the intermediate electrode space (3) as a result of the incorporation of a diaphragm (6) of this kind. In this manner, the thermal loading on the electrodes (1, 2) can be reduced, their service life increased and the mean output or pulse energy that can be injected into the system can be increased, along with the achievable radiation power.

The intermediate electrode space (3) is intended to designate the entire space between the two electrodes (1, 2). It is divided by the diaphragm (6) into two part-areas, each of which is defined by one of the electrodes (including its opening) and the diaphragm (including its opening).

There exists, in particular, the option of providing a greater gas pressure in the part-area of the gas-filled intermediate electrode space (3) defined by the diaphragm (6) and the electrode (2) that faces away from the discharge side of the radiation than in the part-area of the gas-filled intermediate electrode space (3) defined by the diaphragm (6) and the electrode (1) that faces towards the discharge side of the radiation. This measure ensures that the compression, or the injection of energy into the current-carrying plasma and, in association with this, the localization of the area of high impedance, takes place at the desired point close to the electrode (1) facing towards the discharge side of the radiation. This has the advantage that there is optimum usability of the radiation from the point of view of accessibility at large angles of observation. The current transfer from the cathode to this point hereby takes place in a diffuse, low-impedance plasma. As compared with the prior art, in which a plasma channel that is shorter overall arises, this leads to virtually no losses. For this reason also, an increase in radiation power is achievable.

The gas pressure in the intermediate electrode space (3) and the space between the two electrodes are selected such that the ignition of the plasma takes place on the left-hand branch of the Paschen curve, i.e. the ionization processes start along the long electrical field lines, which preferably occur in the area of the openings of the anode and cathode. The ignition therefore takes place in the gas volume and thereby occasions an especially low rate of wear. In addition, in the case of operation on the left branch of the Paschen curve, switching elements between the radiation generator and the power supply are not necessary, making possible a low-induction—and therefore extremely efficient—energy injection.

It is possible to use as the cathode either the electrode (2) facing away from the discharge side of the radiation or the electrode (1) facing towards the discharge side of the radiation. The first alternative has the advantage that the compressed plasma, which may, in this case, owing to the device in accordance with the invention, arise close to the anode (1), is comparatively far away from the cathode (2). As a result, there is less erosion of the cathode. Above all, however, the generation of the pinch plasma also depends less strongly on geometrical changes in the cathode. A higher degree of erosion can thereby be tolerated. Overall, this leads to a considerably longer service life for the electrode system and offers the opportunity of introducing a higher electrical power and thereby achieving a greater radiation power.

Neither is the thermal loading on the electrode (1) facing towards the discharge side of the radiation, e.g. the anode, too excessive, since the diaphragm (6) is capable of dissipating a considerable proportion of the energy. Therefore, owing to the presence of the diaphragm (6), only the proportion of the energy that is injected into the area of the pinch plasma, which emits short-wave radiation, need be taken into account. Since this proportion is equal to only one fifth to one quarter of the total energy, the introducable power and also the pulse energy can thereby be increased accordingly by a factor of 4 to 5.

It is especially advantageous to design the electrode (2) facing away from the discharge side of the radiation as a hollow electrode, especially a hollow cathode, equipped with a cavity (8). Within this, in a first phase of the discharge, a pre-ionization of the gas takes place, followed by the development of a dense hollow-cathode plasma. A plasma of this kind is especially suitable for supplying the necessary charge carriers (electrons) to create a low-impedance channel in the intermediate electrode space (3). The hollow electrode (2) may exhibit one or more openings (9) to the intermediate electrode space (3). Since, as a result of the latter alternative, the entire current is distributed over multiple electrode openings (9), the local loading on the electrode (2) can be reduced in this manner, and the service life of the electrode system, and the introducable electrical power, can thereby be increased. In the cavity (8) of the electrode (2) designed as a hollow cathode, additional triggering devices may be present. In this manner, the ignition of the discharge can be triggered precisely as required. This is advantageous, in particular, in the case of a hollow cathode with multiple openings. The triggering device may be designed as, for example, an auxiliary electrode in the hollow cathode, with which the discharge can be triggered in that the auxiliary electrode is switched from a potential that is positive relative to the cathode to a lower potential, e.g. cathode potential. Further triggering options consist in the injection or generation of charge carriers in the hollow cathode via a glow-discharge trigger, a high-dielectric trigger or the triggering of photoelectrons or metal vapor via light pulses or laser pulses.

It is favorable if the diaphragm (6) is designed in such a way that it contributes to the current transfer to only a small extent at the most. Instead, the entire, or at least the major, proportion of the current transfer from the cathode to the anode takes place largely only via the plasma channel. In this manner, the current can be used as completely and effectively as possible for generation of the pinch plasma. In addition, the generation of cathode spots on the diaphragm, and the erosion thereby arising there, can be largely avoided.

For the manufacture of the diaphragm (6), it is advantageous if the diaphragm (6), or at least a portion of the diaphragm (6), comprises a material that responds well to machining. It is also advantageous if the material of at least a portion of the diaphragm (6) exhibits a high degree of thermal conductivity. This enables effective cooling or heat dissipation.

An example of a material that can be used for at least a portion of the diaphragm (6) is ceramics, in particular aluminum oxide or lanthanum hexaboride.

For the portion of the diaphragm (6) located close to the opening (7), for which portion, owing to its proximity to the plasma channel, the risk of erosion of the diaphragm (6) is greatest, it is favorable to produce this portion from an especially discharge-resistant material, e.g., in particular, molybdenum, tungsten, titanium nitride or lanthanum hexaboride. As a result, the occurrence of erosion on the diaphragm (6) is greatly reduced, and the service life of the device is thereby increased.

It is also possible to introduce multiple diaphragms, each exhibiting an opening (7) on the axis of symmetry (4), into the intermediate electrode space (3). In a particularly advantageous embodiment, these take the form of metallic diaphragms (6, 6', 6"), separated from one another by isolators (11). In this manner, the multi-stage ignition of cathode hot spots, and thereby the current transfer, are effectively suppressed. This provides the same advantage as the use of a single isolator. In addition, a desired low-inductance structure of the electrode system as compared with a purely ceramic body is possible as a result of the incorporation of metal. Moreover, the deposition of metallic vapor on the diaphragm, which could lead to problems in the case of a ceramic diaphragm, plays virtually no role.

The thickness of the diaphragm (6) may lie within a range between approximately 1 and 20 mm. From the point of view of cooling, diaphragms that are as thick as possible should be provided. The diameter of the diaphragm (6) should be roughly between 4 and 20 mm.

It is possible to arrange gas inlets (12) in such a way that their openings face towards the part-area of the gas-filled intermediate electrode space (3) defined by the diaphragm (6) and by the electrode (2) facing away from the discharge side of the radiation. The gas pressure in this part-area can thereby be set specifically. In interaction with the diaphragm (6), a higher gas pressure, in particular, may hereby be provided there than in the part-area of the intermediate electrode space (3) defined by the diaphragm (6) and the electrode (1) facing towards the discharge side of the radiation, or a specific desired pressure difference can be set.

In addition, gas inlets (12') may be present that are equipped with openings towards the part-area of the gas-filled intermediate electrode space (3) defined by the diaphragm (6) and by the electrode (1) facing towards the discharge side of the radiation.

With the incorporation of gas inlets (12, 12') in both part-areas of the intermediate electrode space (3), an especially large tolerance is obtained for regulating the gas-pressure distribution in the intermediate electrode space (3). In addition, in conjunction with the presence of the diaphragm (6), the opportunity of generating an inhomogeneous distribution of the gas composition within the intermediate electrode space (3) is provided as a result. In particular, in an especially advantageous embodiment of the invention, additionally introduced into the part-area of the intermediate electrode space (3) defined by the diaphragm (6) and by the electrode (2) facing away from the discharge side of the radiation, via the gas inlets (12) present there, is a filler gas, such as helium or hydrogen, which, by comparison with the working gas, exhibits very low radiation losses under the pulsed currents used. In this manner, the impedance of the plasma is maintained at a low level here in comparison with the EUV-emitting area, and the energy injection is more effective. Introduced into the part-area of the intermediate electrode space (3) defined by the diaphragm (6) and by the electrode (1) facing towards the discharge side of the radiation, via the gas inlets (12') present there, is the working gas, such as xenon or neon, which is provided for generating the pinch plasma and the resultant emission of EUV radiation.

The evacuation of the gas may take place especially easily by means of an evacuation device located outside the intermediate electrode space, through the opening of the electrode (1) facing towards the discharge side of the radiation. However, it is also possible to provide an evacuation device directly in the intermediate electrode space (3), in particular in the part-area of the intermediate electrode space (3) defined by the diaphragm (6) and by the electrode (1) facing towards the discharge side of the radiation. This is especially advantageous if, as described above, different gas compositions are present in the two part-areas of the intermediate electrode space (3), since a comparatively low blending of the two gas mixtures can then be achieved during the evacuation.

The invention will be further described with reference to examples of embodiments shown in the drawings, to which, however, the invention is not restricted.

Figure 1:
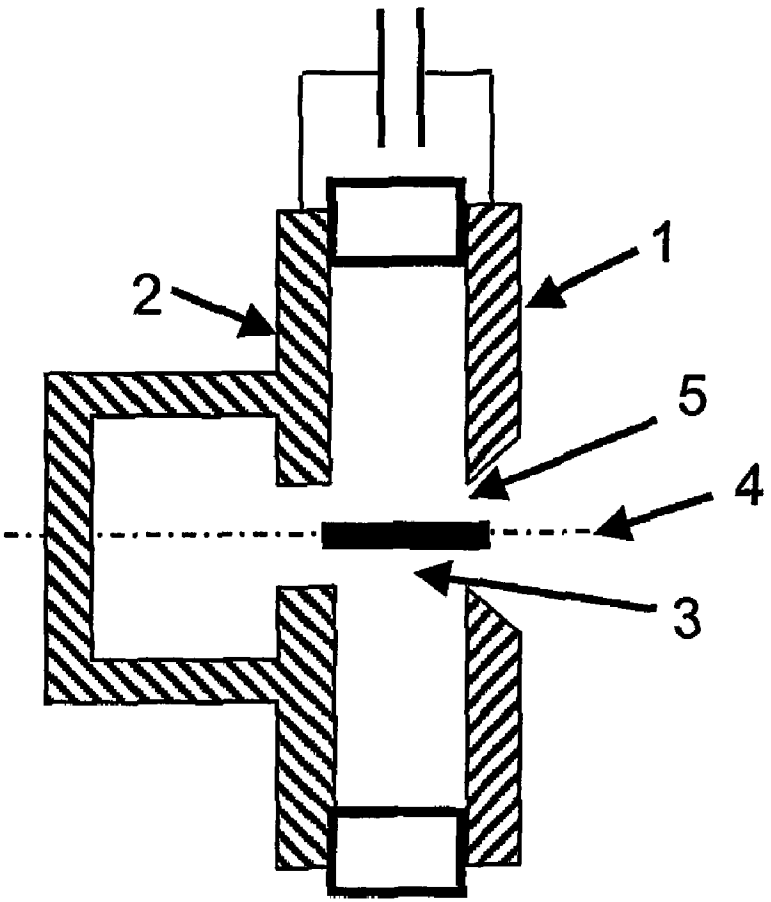
FIG. 1 shows a drawing taken from WO 99/29145, which illustrates the prior art.
Figure 2:
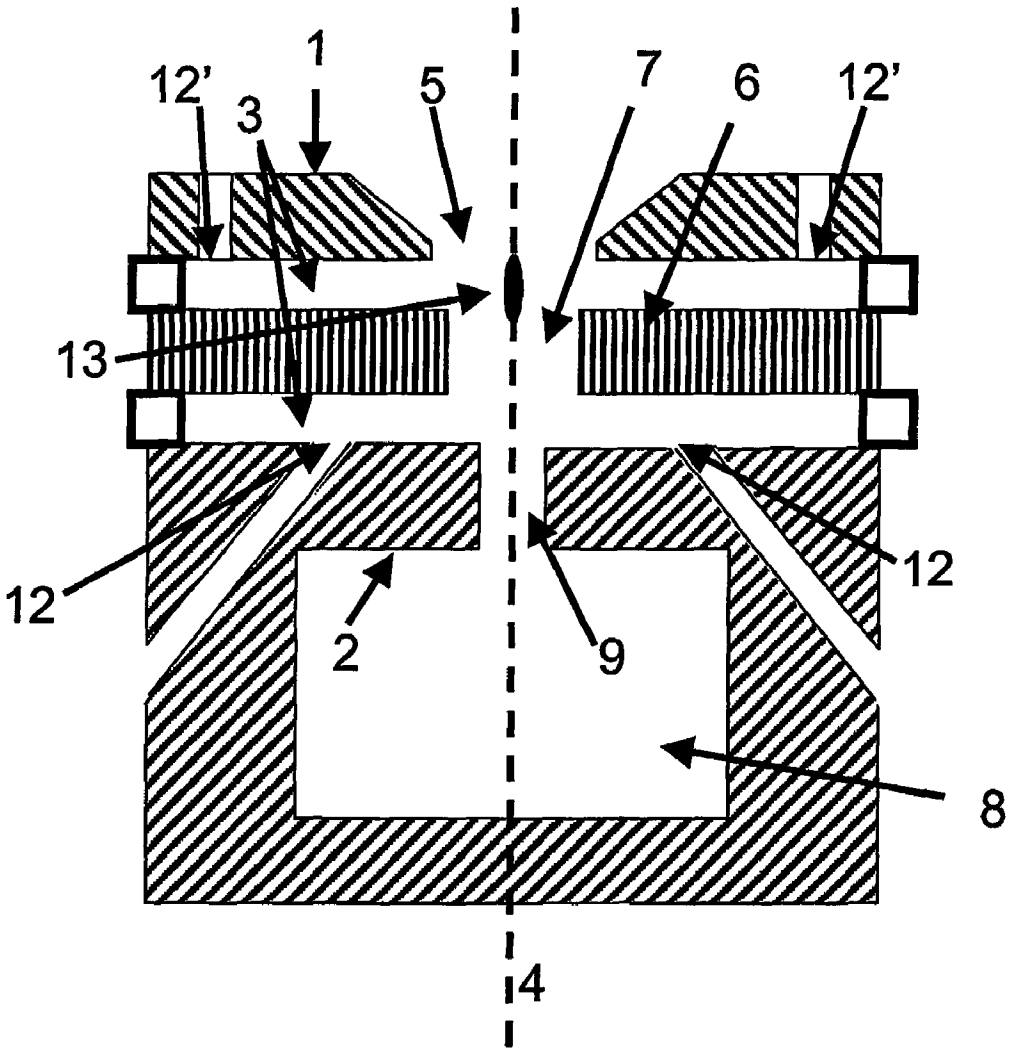
FIG. 2 shows a schematic representation of the device in accordance with the invention.

FIG. 2 shows one embodiment of the electrode system of the device in accordance with the invention. One electrode (2) hereby takes the form of a hollow electrode equipped with a cavity (8), and is used as the cathode. The other electrode (1) acts as the anode. The extraction of the radiation discharged from the pinch plasma (13) generated within the gas-filled intermediate electrode space (3) takes place through the opening (5) in the anode (1). In order to make the highest possible proportion of the emitted radiation usable, the anode opening (5) widens out in the extraction direction. Between the electrodes (1, 2) is arranged a diaphragm (6), which exhibits a through-opening (7) on the axis of symmetry (4) defined by the anode opening (5). In this embodiment, the hollow cathode exhibits an opening (9) to the intermediate electrode space (3), which is also located on the axis of symmetry (4). Gas inlets (12) are present, with openings to the part-area of the gas-filled intermediate electrode space (3) defined by the diaphragm (6) and by the cathode (2). In this embodiment, the feed lines for these gas inlets run through the body of the hollow cathode. Further gas inlets (12') are present, with openings to the part-area of the gas-filled intermediate electrode space (3) defined by the diaphragm (6) and by the anode (1).

Figure 3:
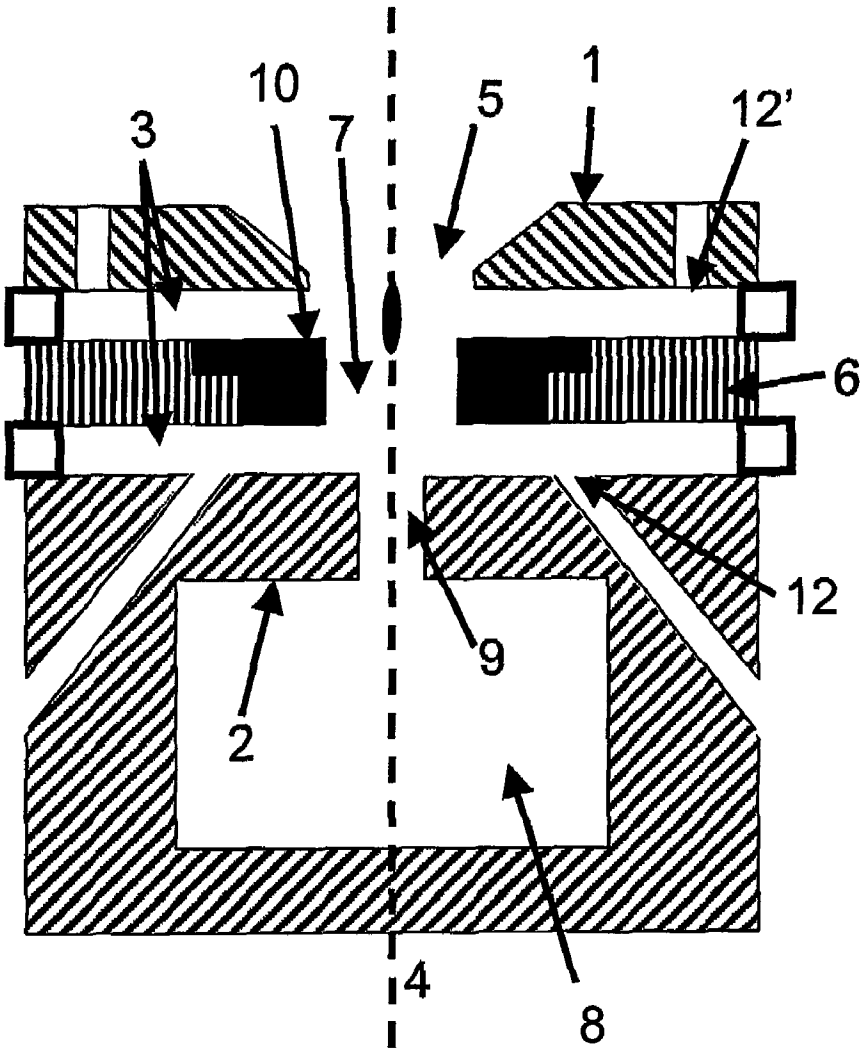
FIG. 3 shows a schematic representation of one embodiment, in which one portion of the diaphragm comprises a discharge-resistant material.

FIG. 3 shows an embodiment of the device in accordance with the invention, in which the diaphragm (6) comprises a discharge-resistant material, e.g. molybdenum, tungsten, titanium nitride or lanthanum hexaboride, in an area (10) close to its opening (7). The remaining portion of the diaphragm (6) comprises a material that is amenable to machining and/or a material with a high thermal conductivity.

Figure 4:
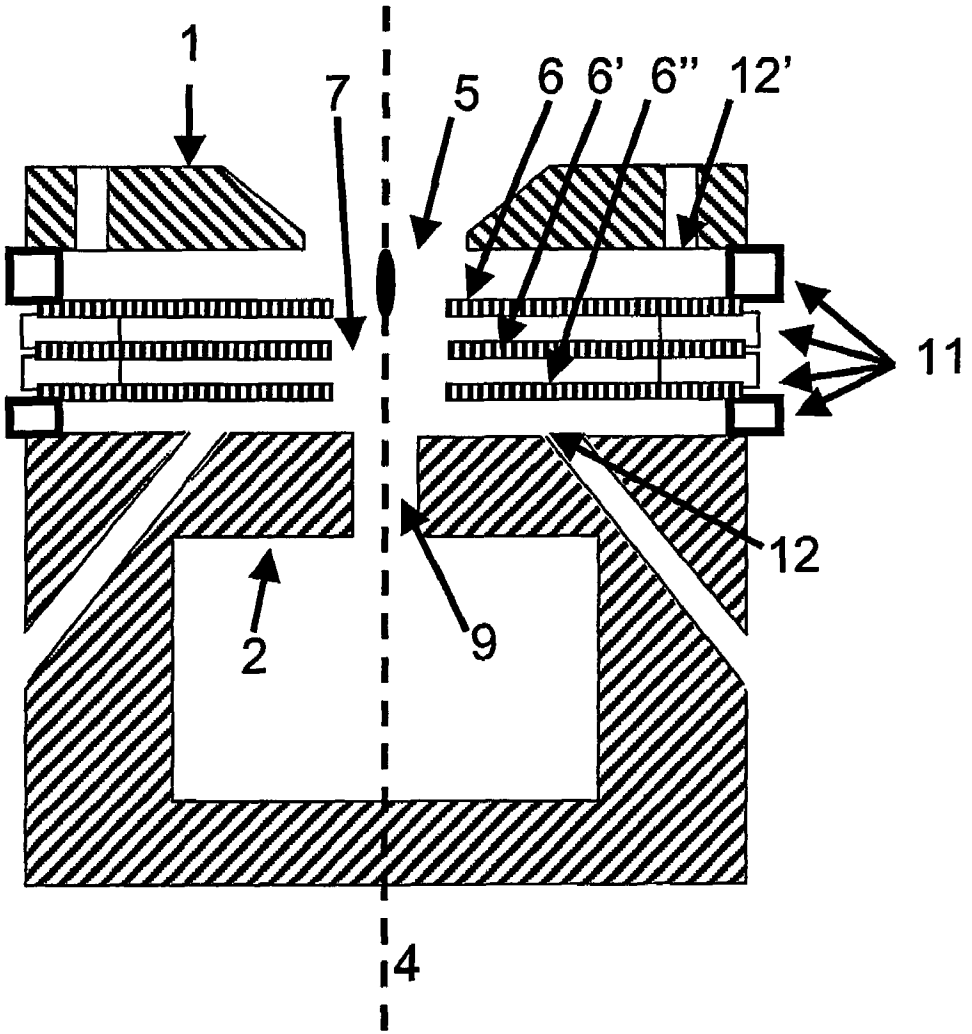
FIG. 4 shows a schematic representation of one embodiment, in which multiple metallic diaphragms are present.

FIG. 4 shows an embodiment of the device in accordance with the invention, in which multiple metallic diaphragms (6, 6', 6") are arranged between the electrodes (1, 2), separated by isolators (11) in each case.

Figure 5:
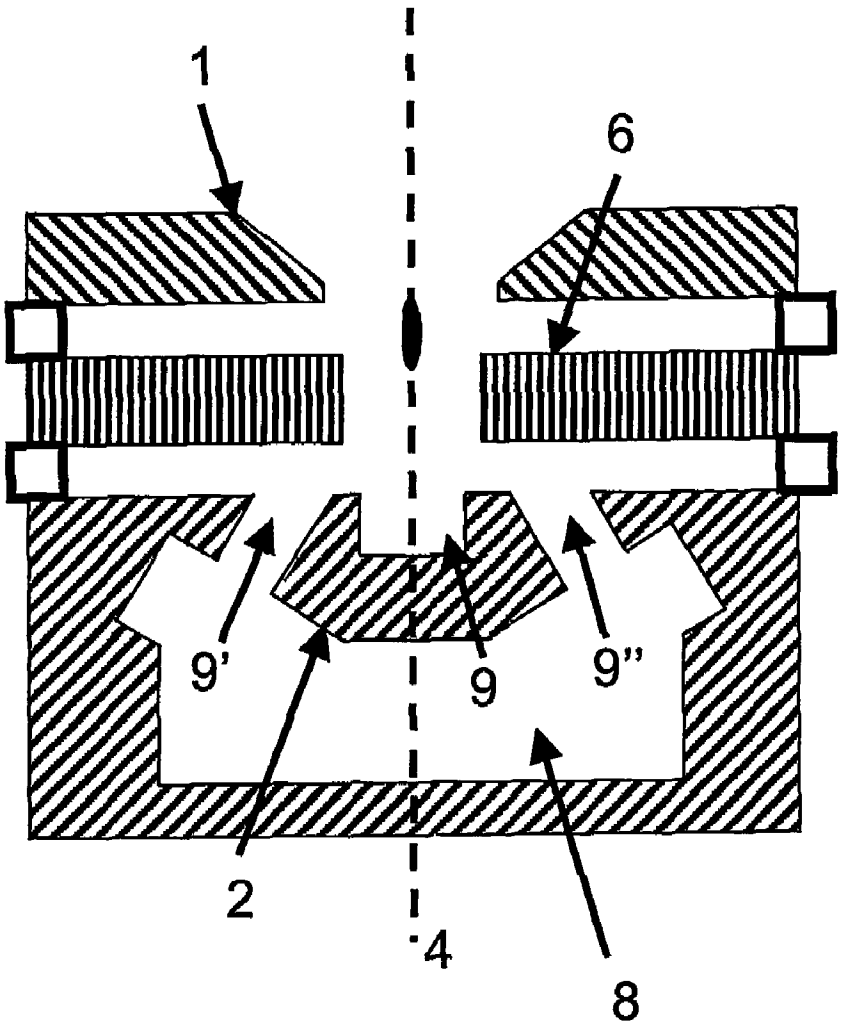
FIG. 5 shows a schematic representation of one embodiment, in which the hollow electrode exhibits multiple openings.

FIG. 5 shows a further embodiment in which the cathode (2) exhibits three openings (9, 9', 9"). The opening (9) located centrally on the axis of symmetry hereby takes the form of a blind hole. The other two openings (9', 9") are through-openings between the cavity (8) of the cathode (2) and the intermediate electrode space (3).

LIST OF REFERENCE NUMBERS

1 Electrode facing towards the discharge side of the radiation
2 Electrode facing away from the discharge side of the radiation
3 (Gas-filled) intermediate electrode space
4 Axis of symmetry
5 Opening in the electrode (1) facing towards the discharge side of the radiation
6 Diaphragm
7 Opening in the diaphragm
8 Cavity in the hollow electrode (2)
9, 9', 9", Opening in the electrode facing away from the discharge side of the radiation
10 Part-area of the diaphragm comprising discharge-resistant material
11 Isolators
12, 12' Gas inlets
13 Pinch plasma

The invention claimed is:

1. A gas discharge source for generating extreme ultraviolet and/or soft X-radiation, comprising:

a first electrode having an opening therein defining an axis of symmetry and providing an outlet for a discharge of radiation;

a second electrode comprising a hollow electrode substantially completely surrounding a cavity save for an opening therethrough positioned along the axis of symmetry, the second electrode opening facing the first electrode; and a diaphragm positioned between the first and the second electrode and having an opening positioned along the axis of symmetry, the diaphragm acting as a differential pump stage, a space between the diaphragm and the first and the second electrode comprising an intermediate electrode space adapted for being filled with a gas, wherein:

the first electrode has a gas inlet leading into the intermediate electrode space from exterior the first electrode; and the second electrode has a gas inlet leading into the intermediate electrode space from exterior the second electrode, the second electrode gas inlet not in direct fluid communication with the cavity.

2. A gas discharge source as claimed in claim 1, wherein the gas pressure in a part-area of the gas-filled intermediate electrode space defined by the diaphragm and the second electrode is greater than in a part-area of the gas-filled intermediate electrode space defined by the diaphragm and the first electrode.

3. A gas discharge source as claimed in claim 1, wherein at least a portion of the diaphragm comprises a ceramic material.

4. A gas discharge source as claimed in claim 1, wherein the diaphragm comprises a discharge-resistant material adjacent the discharge opening.

5. A gas discharge source as claimed in claim 1, wherein the diaphragm comprises multiple metallic diaphragms and multiple isolators for separating the diaphragms.

6. A gas discharge source as claimed in claim 1, wherein, along the axis of symmetry, the diaphragm extends between 1 mm and 20 mm.

7. A gas discharge source as claimed in claim 1, wherein the opening of the diaphragm has a diameter between 4 mm and 20 mm.

8. A gas discharge source as claimed in claim 1, wherein the first electrode gas inlet has a first opening facing toward a first part-area of the intermediate electrode space defined by the diaphragm and by the first electrode, wherein the second electrode gas inlet has an opening facing toward a second part-area of the intermediate electrode space defined by the diaphragm and by the second electrode.

9. A gas discharge source as claimed in claim 8, wherein the intermediate electrode space is adapted for containing a working gas used for the gas discharge and at least one further filler gas exhibiting lower radiation losses than the working gas.

10. A gas discharge source as claimed in claim 9, wherein the first part-area contains a greater proportion of the working gas than the filler gas, and the second part-area contains a greater proportion of the filler gas than the working gas.

11. A gas discharge source as claimed in claim 1, wherein the first electrode opening is adapted for evacuation of the intermediate electrode space (3).

12. A gas discharge source as claimed in claim 1, wherein the second electrode comprises a cathode.

13. A gas discharge source as claimed in claim 1, wherein a spacing and a gas pressure between the first and the second electrode are selected such that the gas discharge takes place on a left branch of a Paschen curve.

* * * * *